US007872945B2

(12) United States Patent
Camwell et al.

(10) Patent No.: US 7,872,945 B2
(45) Date of Patent: Jan. 18, 2011

(54) DYNAMIC EFFICIENCY OPTIMIZATION OF PIEZOELECTRIC ACTUATOR

(75) Inventors: Paul L. Camwell, Calgary (CA); Edwin I. Hildebrandt, Calgary (CA); Andrzej M. Sendyk, Calgary (CA)

(73) Assignee: XAcT Downhole Telemetry, Inc., Calgary, Alberta (CA)

( * ) Notice: Subject to any disclaimer, the term of this patent is extended or adjusted under 35 U.S.C. 154(b) by 908 days.

(21) Appl. No.: 11/786,643

(22) Filed: Apr. 11, 2007

(65) Prior Publication Data

US 2008/0025148 A1 Jan. 31, 2008

Related U.S. Application Data

(60) Provisional application No. 60/790,801, filed on Apr. 11, 2006.

(51) Int. Cl.
*E21B 47/16* (2006.01)

(52) U.S. Cl. ..... 367/82; 340/854.3; 340/855.6; 340/856.4; 310/311; 361/271; 73/632; 333/200

(58) Field of Classification Search ..... 367/82; 340/854.3, 855.5, 856.4; 310/311; 361/271; 73/632; 333/200
See application file for complete search history.

(56) References Cited

U.S. PATENT DOCUMENTS 6,710,508 B2 * 3/2004 Ruby et al. ..... 310/312
7,514,844 B2 * 4/2009 Unkrich ..... 310/317
7,522,016 B2 * 4/2009 Toncich et al. ..... 333/133
7,561,009 B2 * 7/2009 Larson et al. ..... 333/187
7,573,350 B2 * 8/2009 Frank ..... 333/32
7,586,391 B2 * 9/2009 Volatier et al. ..... 333/188
7,602,102 B1 * 10/2009 Barber et al. ..... 310/320
2003/0123326 A1 7/2003 Wisniewski et al.

FOREIGN PATENT DOCUMENTS

CA 2109373 4/1994

OTHER PUBLICATIONS

Bedford and Drumheller, *Introduction to Elastic Wave Propagation*, John Wiley & Sons, pp. 73-82, 1994.
Bleaney, "Alternating current theory" *in Electricity and Magnetism*, pp. 201-207, 3rd Edition, OUP, 1976.
Drumheller, "Acoustical Properties of Drill Strings," *J. of Acous Society of America*, vol. 85, No. 3, pp. 1047-1064, Mar. 1989.
Office Action from Canadian Intellectual Property Office, for Canadian Patent Application No. 2,585,046, dated Jul. 29, 2010.

* cited by examiner

*Primary Examiner*—Albert K Wong
(74) *Attorney, Agent, or Firm*—Klarquist Sparkman, LLP

(57) ABSTRACT

This invention applies to the means whereby capacitance changes due to varying temperature and/or pressure in a piezoelectric transducer used for acoustic telemetry in a drilling environment is dynamically offset by modifying one or more parameters associated with the drive or control circuitry of said transducer. The object of the invention is to closely maintain the transducer in a resonant mode, thereby ensuring optimum energy consumption.

15 Claims, 4 Drawing Sheets

PRIOR ART

PRIOR ART

DYNAMIC EFFICIENCY OPTIMIZATION OF PIEZOELECTRIC ACTUATOR

CROSS REFERENCE TO RELATED APPLICATION

This application claims the benefit of U.S. provisional patent application Ser. No. 60/790,801, filed Apr. 11, 2006, which is incorporated herein by reference.

FIELD

The present invention relates to telemetry apparatus and methods, and more particularly to acoustic telemetry apparatus and methods used in the oil and gas industry.

BACKGROUND

Acoustic telemetry is a method of communication in the well drilling and production industry. In a typical drilling environment, acoustic carrier waves from an acoustic telemetry device are modulated in order to carry information via the drillpipe to the surface. Upon arrival at the surface, the waves are detected, decoded and displayed at the surface.

The theory of acoustic telemetry as applied to communication along drillstrings has a long history, and a comprehensive theoretical understanding was eventually achieved and backed up by accurate measurements (D. S. Drumheller, *Acoustical Properties Of Drill Strings*, J. Acoustical Society of America, 85: 1048-1064, 1989). It is now generally recognized that the nearly regular periodic structure of drillpipe imposes a passband/stopband structure on the frequency response, similar to that of a comb filter. Dispersion, phase non-linearity and frequency-dependent attenuation make drillpipe a challenging medium for telemetry, which situation is made even more challenging by the significant surface and downhole noise generally experienced.

The design of acoustic systems for static production wells has been reasonably successful, as each system can be modified within economic constraints to suit these relatively long-lived applications. The application of acoustic telemetry in the plethora of individually differing real-time drilling situations, however, is much less successful. This is primarily due to the increased noise due to drilling, and the problem of unwanted acoustic wave reflections associated with downhole components, such as the bottom-hole assembly (or "BHA"), typically attached to the end of the drillstring, which reflections can interfere with the desired acoustic telemetry signal. The problem of communication through drillpipe is further complicated by the fact that drillpipe has heavier tool joints than production tubing, resulting in broader stopbands; this entails relatively less available acoustic passband spectrum, making the problems of noise and signal distortion more severe.

To make the situation even more challenging, BHA components are normally designed without any regard to acoustic telemetry applications, enhancing the risk of unwanted and possibly deleterious reflections caused primarily by the BHA components.

When exploring for oil or gas, or in coal mine drilling applications, an acoustic transmitter is preferably placed near the BHA, typically near the drill bit where the transmitter can gather certain drilling and formation data, process this data, and then convert the data into a signal to be broadcast to an appropriate receiving and decoding station. In some systems, the transmitter is designed to produce elastic extensional stress waves that propagate through the drillstring to the surface, where the waves are detected by sensors, such as accelerometers, attached to the drill string or associated drilling rig equipment. These waves carry information of value to the drillers and others who are responsible for steering the well. There are several ways in which extensional waves may be produced, but for exemplary purposes the following discussion shall concentrate on a transducer comprising a stack of piezoelectric discs (the 'stack'), arranged physically in series, that are constrained between two metal shoulders disposed on a mandrel, protected by a cover, the stack being energised by the application of a high voltage. As this high voltage is applied it causes the stack to either increase or decrease its axial length, and this is transferred to the mandrel and cover. Elastic deformation of the mandrel and cover due to periodic changes in the applied voltage causes extensional waves to propagate away from the two faces of the stack.

The periodic changes in the applied voltage have a repetition rate that matches one of the passband filter effects of typical drillpipe (A. Bedford and D. S. Drumheller, *Introduction to Elastic Wave Propagation*, John Wiley & Sons, Chichester, 1994). A simple way to apply a periodic high voltage to a stack is to utilize a transformer whose secondary winding is connected to the stack, and whose primary winding is attached to a switching unit and a power source, such as a battery. Although there are other ways of achieving a switched high voltage across the stack, this example shall be employed in the following for illustrative purposes. The stack's major electrical characteristic is as a capacitor, while the transformer appears most significantly as an inductance. In order that the transmitter system is run efficiently it is helpful to make the practical transformer/stack combination (i.e. tank circuit) resonant with a resonance quality factor (Q) of the order 4 to 10. It will be evident that the most efficient utilization of such a resonant circuit is to operate in the centre of its resonance band, implying that the stack's capacitance and the transformer's inductance is matched at the resonant frequency. The basic problem is that the stack's capacitance can markedly change due to changes in either temperature or externally applied pressure, or both. These effects can push the tank circuit out of resonance, leading to inefficient use of the power source. The stack must necessarily be subject to the mechanical compression and tension of drillstring forces transferred into the mandrel and cover, primarily because it must transfer its wave energy out into the drillstring via the mandrel and cover. The dynamic mechanical loading of the stack due to varying drilling conditions is particularly difficult to manage, and ideally would require a closed loop system to compensate. Temperature changes, although not so changeable as pressure, are still significant and thus also have a significant effect on the stack.

SUMMARY

It is an object of certain embodiments of the present invention to improve the efficiency performance of a piezoelectric actuator that is the primary transducer in converting electrical impulses into mechanical extensional waves. For efficiency reasons the piezoelectric actuator, electrically acting as a capacitor, is resonantly coupled to a transformer, electrically acting as an inductor. If the coupled circuit goes out of resonance it will either consume excessive current or significantly reduce its wave energy output, depending on the electrical coupling topology chosen (either parallel or series). The operating frequency of the combined circuit is kept substantially in resonance by adjusting the inductance value, which in one embodiment is accomplished by switching various taps on the transformer, said taps chosen to compensate for the changes in capacitance of the actuator that are brought about by changes in both operating temperature and externally applied pressure. The compensation means is preferably implemented as a closed loop control circuit (i.e. feedback) able to dynamically switch in the appropriate transformer tap such that a close to resonance condition is substantially met.

According to one aspect, there is provided an acoustic telemetry signal generation system for a drillstring comprising a circuit. The circuit comprises a transducer and an inductor, and the system is adjustable in order to compensate for undesired changes of capacitance of the transducer by utilizing a feedback loop comprising means to modify the value of the inductance of the inductor such that the circuit operates in a substantially resonant state. Such means to modify the value of the inductance can comprise one or more than one switching taps on the transformer.

The transducer can be a piezoelectric actuator converting electrical impulses into mechanical extensional waves. The piezoelectric actuator can be a piezoelectric stack. The piezoelectric actuator can electrically act as a capacitor and be resonantly coupled to a transformer electrically acting as an inductor.

The system can further comprise a detector for detecting changes of capacitance of the transducer. The detector can be in communication with the means to modify the value of the inductance, such that when the capacitance of the transducer exceeds a predetermined limit the means to modify the value of the inductance is initiated.

The circuit can be a parallel tank circuit and in which case the detector measures an average current flowing into the parallel tank circuit, and in conjunction with the means to modify the value of the inductance, is operable to vary the average current flowing into the parallel tank circuit as required by a resonance condition of the parallel tank circuit. Alternatively, the circuit can be a serial tank circuit and the detector measures a voltage amplitude developed in the serial tank circuit, and in conjunction with the means to modify the value of the inductance, is operable to vary the voltage amplitude as required by a resonance condition of the serial tank circuit.

The circuit can further comprise: a primary side comprising a controller, a periodic signal switch and a primary winding of the transformer, the controller configured to activate the periodic signal switch to produce a primary current pulse that flows through the primary winding; and a secondary side comprising a secondary winding of the transformer and the piezoelectric actuator, the secondary side of the circuit being operable to produce a secondary sinusoidal voltage.

The system can further comprise a sensor to detect the primary current pulse and the secondary sinusoidal voltage. The system can also further comprise a signal-processing module configured to determine a circuit time lag between the primary current pulse and a peak of the secondary sinusoidal voltage and compare the circuit time lag to an optimal time lag expected in an optimum resonance situation.

The means to modify the value of the inductance can comprise one or more than one switching taps on the transformer and a tap controller. In such case, the signal-processing module is in communication with the one or more than one switching tap, such that when the circuit time lag exceeds a predetermined limit the signal-processing module causes the tap controller to switch the one or more than one tap and reach a condition closer to resonance.

According to another aspect, there is provided an acoustic telemetry signal generation system for a drillstring comprising a resonating circuit, the circuit comprising: a piezoelectric actuator electrically acting as a capacitor and converting electrical impulses into mechanical extensional waves; a transformer electrically acting as an inductor and resonantly coupled to the piezoelectric actuator, the transformer having one or more than one switching taps; a detector for detecting changes of electrical capacitance of the piezoelectric actuator, the detector being in communication with the one or more than one switching taps on the transformer; wherein the circuit further comprises a feedback loop, the feedback loop operable to dynamically switch in the appropriate switching tap when an capacitance of the piezoelectric actuator exceeds a predetermined limit such that a close to resonance condition is substantially met. The detector can comprise a signal-processing module that measures a circuit time lag between a primary current pulse and a peak of a secondary sinusoidal voltage of the transformer.

BRIEF DESCRIPTION OF THE DRAWINGS

The following drawings illustrate the principles of the present invention and an exemplary embodiment thereof.

DETAILED DESCRIPTION

Figure 1:
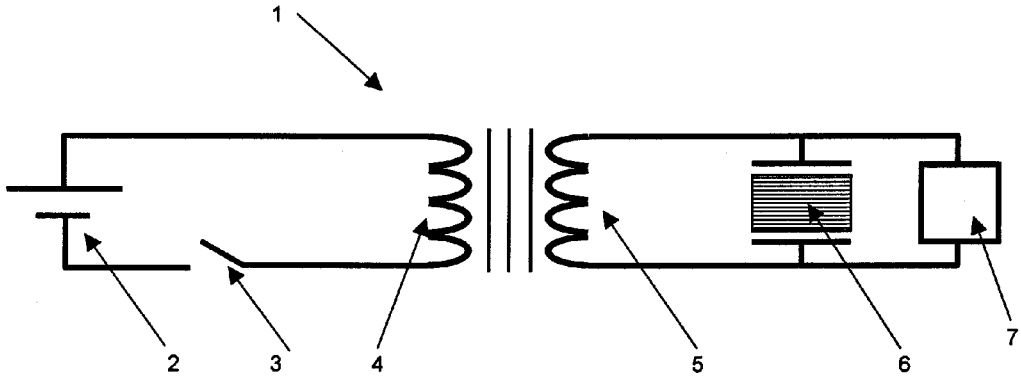
FIG. 1 shows a simplified view of a Prior Art transformer/piezoelectric stack circuit incorporating a switched power source.

FIG. 1 illustrates a very simple known form of resonant circuit, in this embodiment comprising a parallel tuned circuit 1. Its components are a battery power source 2 that switches 3 current into the transformer primary winding 4. The transformer secondary winding 5 is connected across the capacitive piezoelectric stack 6 and the load 7. The load 7, shown as an electrical load for illustrative purposes, comprises the mechanical impedance against which the stack 6 reacts as the applied voltage from the transformer causes it to expand or contract.

A parallel circuit has been illustrated, but to one skilled in the art it is obvious that similar comments apply to other resonant circuit topologies, for instance a series tuned circuit (B. I. Bleaney and B. Bleaney, *Electricity and Magnetism* (Third Edition), OUP, 1976).

Figure 2:
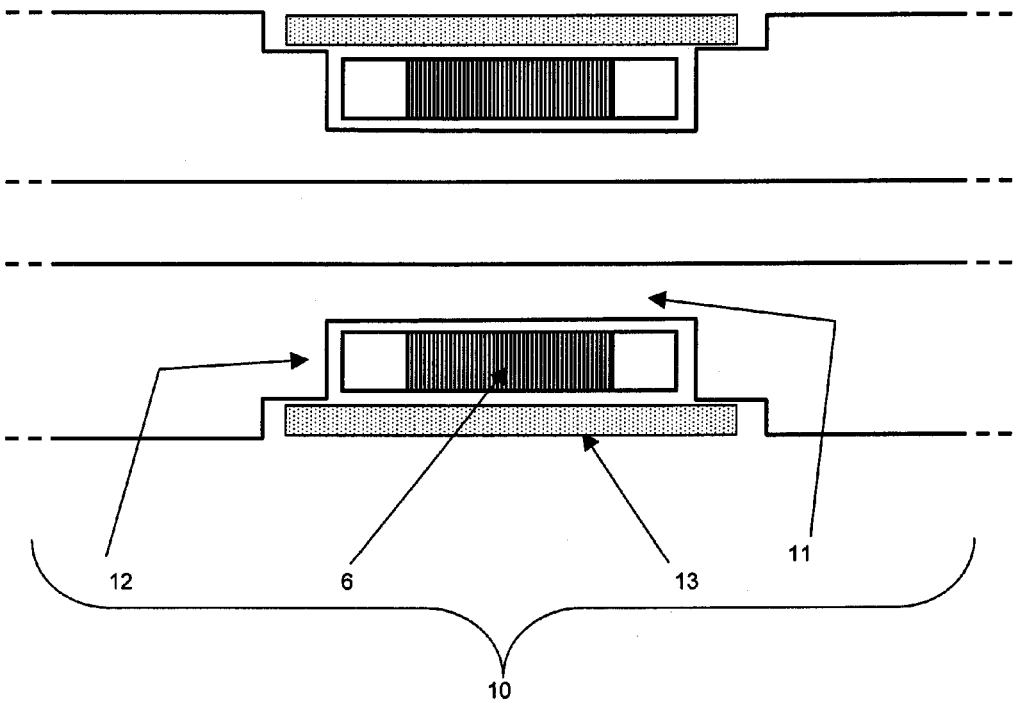
FIG. 2 illustrates how the piezoelectric stack of FIG. 1 is implemented in a toroidal shape and assembled around a hollow mandrel, the assembly being protected by a tubular cover.

The mechanical impedance against which the stack reacts is illustrated by the assembly 10 depicted in FIG. 2. The piezoelectric stack 6 and its insulating end plates are toroidal in shape and disposed about a small diameter section of drill collar (the mandrel 11) and compressed by shoulder sections of the drill collar 12. Drilling mud flows down the centre and outsides of the drill collar and thus the stack 6 is protected by a cover 13. Stack compression (or preload) is preferably employed in order to keep the individual discs of the stack 6 tightly pushed together, both for mechanical integrity and electrical connection reasons. Furthermore, the compression should be adequate to overcome disc separation when the drill collar is subject to bending influences, for instance when the tool is used for directional drilling.

The assembly 10 is screwed on to further drill collars and the like, which ultimately connect to drillpipe, thus enabling the transfer of the extension waves from the stack 6 to an acoustic receiver located at the surface or at some intermediate position. It will now be evident that, in addition to the preload compression and bending forces on the stack 6, there will be other load changes that include the transferred operating 'weight on bit' and hydrostatic and hydrodynamic forces associated with the drilling fluid. The most dynamically changing force is that due to the weight on bit. Ideally this is kept relatively constant but in practise can be subject to extreme shock and vibration as the drill cuts through the formation.

Figure 3:
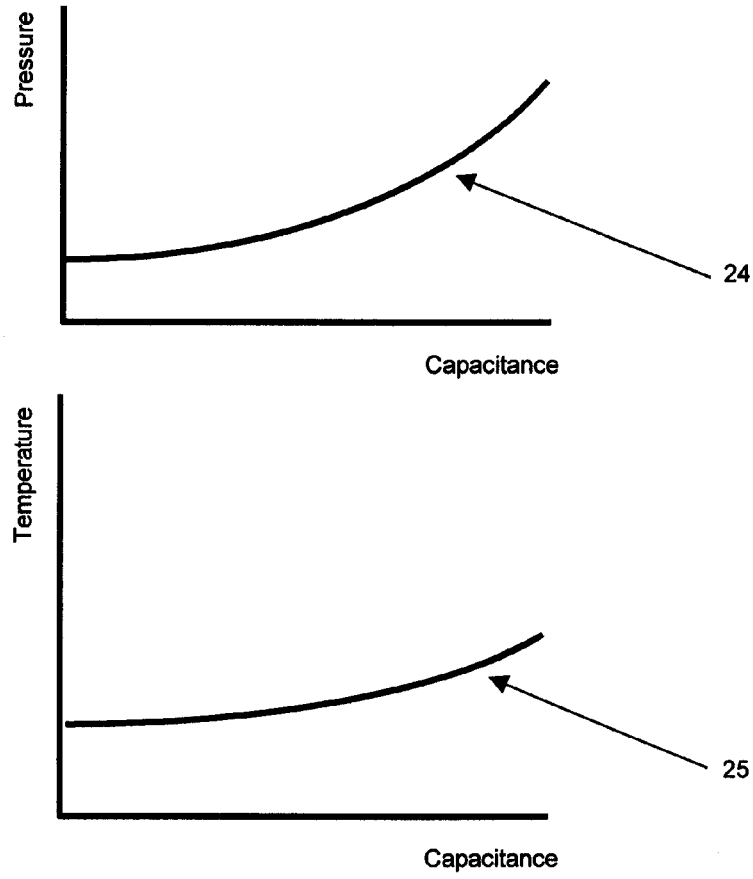
FIG. 3 depicts two graphs—the first indicating how the piezoelectric stack increases its capacitance as pressure is applied to the two toroidal faces as shown in FIG. 2. The second graph similarly shows the capacitance increasing as the stack's temperature is raised.

FIG. 3 shows a representation of experimentally verified graphs that are useful in predicting capacitance changes. Graph 24 relates capacitance to pressure and graph 25 relates capacitance to temperature. Test results have shown that in real applications the net capacitance change due to the combination of these two variables can easily double the room temperature preloaded capacitance of the stack 6. A change of this magnitude can drive the simple circuit shown in FIG. 1 out of its efficient resonant mode, leading to significantly non-optimum operation.

Figure 4A:
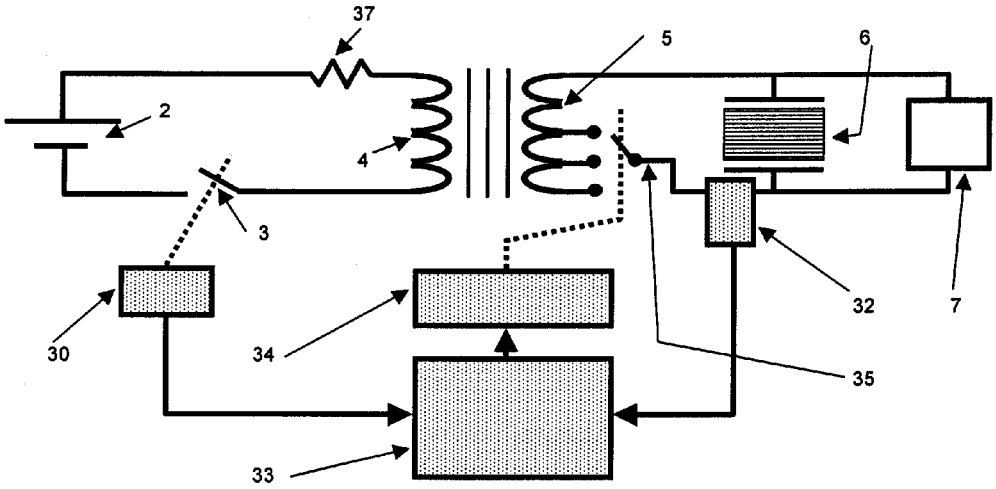
FIG. 4*a* shows one means by which current is switched through the primary winding of the tank circuit, the secondary voltage being sampled, and how the secondary inductance can be switched in order that the circuit may be brought toward resonance.

Because the basic issue is that the stack can dynamically change its capacitance due to the effects discussed so far, it is now apparent that one means of accommodating this change is to dynamically modify the inductance that in conjunction with the transducer capacitance forms a resonant circuit. In one embodiment of the invention this is accomplished by switching taps on the transformer as shown in FIG. 4*a*. There are many other methods by which the inductance value can be modified (adjusting inductance core air gap methods, dc current bias, etc.) but the following method will be utilised for illustrative purposes.

Figure 4B:
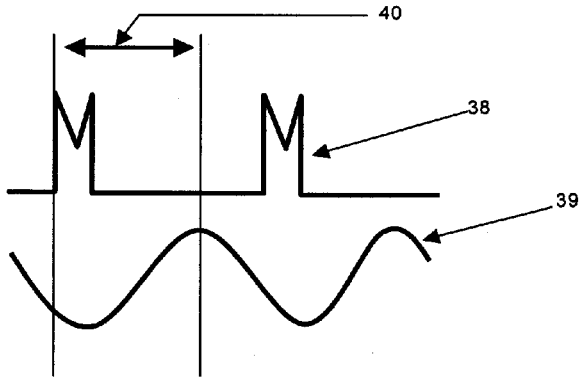
FIG. 4*b* indicates two waveforms—the first is a representation of the switched primary current, the second is a representation of the secondary voltage, with relative timing between certain features also being indicated.

A controller 30 activates a periodic signal switch 3 on the primary side 4 of the transformer. As a result current pulses 38, as illustrated in FIG. 4*b*, will flow from battery 2 through a current limiting resistor 37 and the primary winding of the transformer 4. The resonating circuit comprising the secondary transformer winding 5 and stack 6 will develop an approximately sinusoidal voltage 39, as illustrated in FIG. 4*b*. This voltage is sensed by a peak-detect sensor 32. The time lag 40 illustrated in FIG. 4*b* between the primary current pulse and the secondary voltage peak is measured by a signal-processing module 33 and it is compared to the lag expected in an optimum resonance situation. When the stack capacitance increases/decreases this lag will also increase/decrease. When the lag exceeds a predetermined limit the signal-processing module 33 causes the tap controller 34 to switch the tap 35 and reach a condition closer to resonance. The feedback loop time response characteristic can be chosen to make these changes as dynamically as the drilling conditions require.

Again, this is only one of many possible implementations; in another implementation the apparatus measures the average current flowing into a parallel inductance/capacitance tank circuit and in conjunction with an inductance controller will attempt to minimize this current as required by the resonance condition. In yet another implementation the apparatus measures the voltage amplitude developed in a series resonant circuit, and in conjunction with an inductance controller will attempt to maximize this voltage as required by the resonance condition (strictly speaking the current is maximized at resonance but the resonance condition is adequately determined by measuring voltage across either the inductance or the capacitance).

In a further implementation, if the tank is required to develop a chirp signal (a monotonic excursion from one frequency to another) rather than a single frequency sinusoid, the position of the minimum of current pulses for a parallel tank circuit (or the position of a voltage maximum for a serial tank circuit) in relation to the start of the chirp could be measured. Then the signal-processing module in conjunction with the inductance controller will attempt to keep the current (or voltage as appropriate) parameter aligned with the centre of the chirp. In yet another implementation the apparatus could merely measure the stack capacitance, providing that the measurement does not interfere with generation of acoustic waveform, and vice versa. Using a look-up table, the inductance required for resonance could be calculated and selected by the inductance controller means.

One or more embodiments have been described by way of example. It will be apparent to persons skilled in the art that a number of variations and modifications can be made without departing from the scope of the invention as defined in the claims.

We claim:

1. An acoustic telemetry signal generation system for a drillstring comprising a circuit, the circuit comprising:

a transducer;

an inductor; and a detector for detecting changes of capacitance of the transducer, the system being adjustable in order to compensate for undesired changes of capacitance of the transducer by utilizing a feedback loop comprising means to modify the value of the inductance of the inductor in response to a signal from the detector such that the circuit operates in a substantially resonant state.

2. The signal generation system of claim 1, wherein the transducer is a piezoelectric actuator converting electrical impulses into mechanical extensional waves.

3. The signal generation system of claim 2, wherein the piezoelectric actuator is a piezoelectric stack.

4. The signal generation system of claim 2, wherein the piezoelectric actuator electrically acts as a capacitor and is resonantly coupled to a transformer electrically acting as the inductor.

5. The signal generation system of claim 4, wherein the means to modify the value of the inductance of the inductor such that the circuit approaches resonance comprises one or more than one switching taps on the transformer.

6. The signal generation system of claim 1, wherein the detector is in communication with the means to modify the value of the inductance of the inductor such that the circuit approaches resonance, such that when the capacitance of the transducer exceeds a predetermined limit the means to modify the value of the inductance of the inductor such that the circuit approaches resonance is initiated.

7. The signal generation system of claim 1, wherein the circuit is a parallel tank circuit and the detector measures an average current flowing into the parallel tank circuit, and in conjunction with the means to modify the value of the inductance of the inductor such that the circuit approaches resonance, is operable to vary the average current flowing into the parallel tank circuit as required by a resonance condition of the parallel tank circuit.

8. The signal generation system of claim 1, wherein the circuit is a serial tank circuit and the detector measures a voltage amplitude developed in the serial tank circuit, and in conjunction with the means to modify the value of the inductance of the inductor such that the circuit approaches resonance, is operable to vary the voltage amplitude as required by a resonance condition of the serial tank circuit.

9. The signal generation system of claim 4 wherein the circuit comprises:

a primary side comprising a controller, a periodic signal switch and a primary winding of the transformer, the controller configured to activate the periodic signal switch to produce a primary current pulse that flows through the primary winding; and a secondary side comprising a secondary winding of the transformer and the piezoelectric actuator, the secondary side of the circuit being operable to produce a secondary sinusoidal voltage.

10. The signal generation system of claim 9, further comprising a sensor to detect the primary current pulse and the secondary sinusoidal voltage.

11. The signal generation system of claim 10, further comprising a signal-processing module configured to determine a circuit time lag between the primary current pulse and a peak of the secondary sinusoidal voltage and compare the circuit time lag to an optimal time lag expected in an optimum resonance situation.

12. The signal generation system of claim 11, wherein the means to modify the value of the inductance of the inductor such that the circuit approaches resonance comprises one or more than one switching taps on the transformer and a tap controller, and the signal-processing module is in communication with the one or more than one switching tap, such that when the circuit time lag exceeds a predetermined limit the signal-processing module causes the tap controller to switch the one or more than one tap and reach a condition closer to resonance.

13. The signal generation system of claim 1, wherein the detector measures the capacitance of the transducer.

14. An acoustic telemetry signal generation system for a drillstring comprising a resonating circuit, the circuit comprising:

a piezoelectric actuator electrically acting as a capacitor and converting electrical impulses into mechanical extensional waves;

a transformer electrically acting as an inductor and resonantly coupled to the piezoelectric actuator, the transformer having one or more than one switching taps;

a detector for detecting changes of electrical capacitance of the piezoelectric actuator, the detector being in communication with the one or more than one switching taps on the transformer;

wherein the circuit further comprises a feedback loop, the feedback loop operable to dynamically switch in the appropriate switching tap when an a capacitance of the piezoelectric actuator exceeds a predetermined limit such that a close to resonance condition is substantially met.

15. The signal generation system of claim 14, wherein the detector comprises a signal-processing module that measures a circuit time lag between a primary current pulse and a peak of a secondary sinusoidal voltage of the transformer.

* * * * *